US007490605B2

(12) United States Patent
Frye et al.

(10) Patent No.: US 7,490,605 B2
(45) **Date of Patent: *Feb. 17, 2009**

(54) HIGH EFFICIENCY LIQUID OXYGEN SYSTEM

(75) Inventors: Mark R. Frye, Bloomington, IN (US); Leonardo S. Toma, Indianapolis, IN (US); Richard A. Davis, Ballwin, MO (US)

(73) Assignee: Mallinckrodt, Inc., St. Louis, MO (US)

( * ) Notice: Subject to any disclaimer, the term of this patent is extended or adjusted under 35 U.S.C. 154(b) by 14 days.

This patent is subject to a terminal disclaimer.

(21) Appl. No.: 10/658,793

(22) Filed: Sep. 10, 2003

(65) Prior Publication Data

US 2005/0247308 A1 Nov. 10, 2005

Related U.S. Application Data

(63) Continuation of application No. 09/696,170, filed on Oct. 26, 2000, now Pat. No. 6,742,517.

(60) Provisional application No. 60/162,131, filed on Oct. 29, 1999.

(51) Int. Cl.
*A62B 7/06* (2006.01)

(52) U.S. Cl. ..... 128/201.21; 128/DIG. 27; 62/50.1; 62/50.2

(58) Field of Classification Search ..... 128/201.21, 128/DIG. 27, 204.26, 205.22; 62/45.1, 48.1, 62/50.1, 50.2, 50.7
See application file for complete search history.

(56) References Cited

U.S. PATENT DOCUMENTS 3,572,048 A * 3/1971 Murphy ..... 62/50.2
3,864,928 A 2/1975 Eigenbrod ..... 62/50
4,211,086 A * 7/1980 Leonard et al. ..... 62/48.1
4,501,270 A * 2/1985 Ulinskas ..... 128/202.13
4,541,276 A * 9/1985 Perkins ..... 73/296
4,664,146 A * 5/1987 Carter ..... 137/599.05

(Continued)

FOREIGN PATENT DOCUMENTS

GB 1185199 * 3/1970

(Continued)

OTHER PUBLICATIONS

PCT International Search Report, PCT/US00/29374, 2 pages.

*Primary Examiner*—Patricia M Bianco
(74) *Attorney, Agent, or Firm*—Fletcher Yoder

(57) ABSTRACT

A high-efficiency liquid oxygen (LOX) storage/delivery system utilizes a portable LOX/delivery apparatus with a portable LOX container. A portable-unit LOX transfer connector is connected to the portable LOX container and is connectable to a main source of LOX in a primary reservoir LOX container. A portable-unit oxygen gas transfer connector is provided for transferring oxygen gas from the portable LOX container to an oxygen gas delivery device for delivering oxygen gas to a patient. An inter-unit oxygen gas transfer connector also is provided for connecting the portable apparatus to a stationary source of oxygen gas in the primary reservoir container, for transferring oxygen gas to the portable apparatus. A portable-unit primary relief valve is connected to the portable LOX container for venting oxygen gas out of the portable LOX container when pressure in the portable LOX container reaches a predetermined level.

19 Claims, 3 Drawing Sheets

U.S. PATENT DOCUMENTS

| | | | | | |
|---|---|---|---|---|---|
| 5,357,758 | A | * | 10/1994 | Andonian | 62/45.1 |
| 5,417,073 | A | | 5/1995 | James et al. | 62/51.1 |
| 5,511,542 | A | * | 4/1996 | Hall | 128/201.21 |
| 5,881,725 | A | * | 3/1999 | Hoffman et al. | 128/204.26 |
| 5,906,100 | A | | 5/1999 | Caldwell et al. | 62/50.1 |
| 6,089,226 | A | * | 7/2000 | Gier | 128/201.21 |
| D436,401 | S | * | 1/2001 | Remes et al. | D24/164 |
| D437,056 | S | | 1/2001 | Remes et al. | D24/164 |
| 6,446,630 | B1 | * | 9/2002 | Todd, Jr. | 128/204.18 |
| 6,651,653 | B1 | * | 11/2003 | Honkonen et al. | 128/201.21 |
| 6,742,517 | B1 | * | 6/2004 | Frye et al. | 128/201.21 |
| 6,880,556 | B2 | * | 4/2005 | Uchiyama et al. | 128/205.24 |
| 6,895,961 | B1 | * | 5/2005 | Todorov | 128/201.27 |

FOREIGN PATENT DOCUMENTS

| | | |
|---|---|---|
| WO | 98/58219 | 12/1996 |

* cited by examiner

HIGH EFFICIENCY LIQUID OXYGEN SYSTEM

CROSS-REFERENCE TO RELATED APPLICATION

This application is a continuation of application Ser. No. 09/696,170, filed Oct. 26, 2000 now U.S. Pat. No. 6,742,517, which is hereby incorporated by reference The present application claims priority from U.S. Provisional patent application Ser. No. 60/162,131, filed Oct. 29, 1999. The disclosure of the above-referenced provisional patent application is incoroporated herein by reference in its entirety.

BACKGROUND OF THE INVENTION

1. Field of the Invention

The present invention relates generally to a liquid oxygen storage and delivery system.

2. Description of the Background Art

Therapeutic oxygen is the delivery of relatively pure oxygen to a patient in order to ease pulmonary/respiratory problems. When a patient suffers from breathing problems, inhalation of oxygen may ensure that the patient is getting an adequate level of oxygen into his or her bloodstream.

Therapeutic oxygen may be warranted in cases where a patient suffers from a loss of lung capacity for some reason. Some medical conditions that may make oxygen necessary are chronic obstructive pulmonary disease (COPD) including asthma, emphysema, etc., as well as cystic fibrosis, lung cancer, lung injuries, and cardiovascular diseases, for example.

Related art practice has been to provide portable oxygen in two ways. In a first approach, compressed oxygen gas is provided in a pressure bottle, and the gas is output through a pressure regulator through a hose to the nostrils of the patient. The bottle is often wheeled so that the patient may be mobile. This is a fairly simple and portable arrangement.

The drawback of compressed, gaseous oxygen is that a full charge of a bottle that is portable does not last a desirable amount of time.

In order to get around this limitation, in a second approach a related art liquid oxygen (LOX) apparatus has been used wherein LOX is stored in a container and the gaseous oxygen formed from the LOX is inhaled by the patient.

The related art LOX apparatus enjoys a longer usable charge than the compressed gas apparatus for any given size and weight, but has its own drawbacks.

Related art LOX systems typically include a stationary storage container located in a patient's home and a portable unit that the patient uses outside the home. The stationary storage container must be periodically refilled with LOX by a distributor.

A significant percentage of the cost of having a LOX system is in the cost of frequent recharging trips by the LOX distributor. A distributor may have to make weekly recharge trips to a patient's home, or even more frequently, to recharge the patient's LOX system. There thus is a need in the art to cut deliveries or cut costs in other ways.

The main drawback of the related art is that considerable waste occurs. One source of waste is that prior art devices provide continuous flow. Also, in the related art, the portable unit may be filled with LOX and used for normal activities and movement. When the patient is done using the related art portable unit, remaining LOX left within the related art portable unit is vented, wasting any remaining oxygen. Because the LOX continues to convert to gaseous oxygen when not being withdrawn, venting is provided for in both the stationary and portable related art units. When the pressure in the related art stationary unit increases beyond a certain point (such as when the related art portable unit is being used), the related art stationary unit must be vented.

There remains a need in the art, therefore, for an improved LOX storage and delivery system, with less gas consumption and requiring fewer deliveries of LOX to the patients home.

SUMMARY OF THE INVENTION

A high-efficiency liquid oxygen (LOX) storage/delivery system is provided according to a first aspect of the invention. The high-efficiency liquid oxygen (LOX) storage/delivery system may include a primary reservoir LOX storage/delivery apparatus comprising a primary reservoir LOX container and a portable LOX/delivery apparatus including a portable LOX container. The primary reservoir LOX apparatus includes a main LOX transfer connector connected to the primary reservoir LOX container for inputting LOX into the primary reservoir LOX container and for outputting LOX from the primary reservoir LOX container to the portable LOX container, and a main-unit oxygen gas transfer connector for transferring oxygen gas from the primary reservoir LOX container. A primary reservoir indicator device may be connected to the primary reservoir LOX container for indicating the LOX contents of the primary reservoir LOX container. A main-unit primary relief valve is connected to the primary reservoir LOX container for venting oxygen gas out of the primary reservoir LOX container when pressure of oxygen gas in the primary reservoir LOX container reaches a predetermined level for the primary reservoir container. The portable LOX apparatus includes a portable-unit LOX transfer connector connected to the portable LOX container and connectable to the main LOX transfer connector for transferring LOX to the portable container from the primary reservoir container, a portable-unit oxygen gas transfer connector for transferring oxygen gas from the portable LOX container to an oxygen gas delivery device for delivering oxygen gas to a patient, an inter-unit oxygen gas transfer connector for connecting the portable apparatus to the main-unit oxygen gas transfer connector for transferring oxygen gas from the primary reservoir container to the portable apparatus, and a portable-unit primary relief valve connected to the portable LOX container for venting oxygen gas out of the portable LOX container when pressure in the portable LOX container reaches a predetermined level for the portable container. When the inter-unit oxygen gas transfer connector of the portable container is connected to the main-unit oxygen transfer connector of the primary reservoir container, oxygen gas can be transferred from the portable container to the oxygen gas delivery device while oxygen gas is transferred to the portable container from the primary reservoir LOX container.

A method for utilizing a high-efficiency liquid oxygen (LOX) storage/delivery system is provided according to a second aspect of the invention. One method comprises connecting the inter-unit oxygen gas transfer connector of a portable container to the main-unit oxygen transfer connector of a primary reservoir container, and withdrawing oxygen gas from the portable container through the portable-unit oxygen gas transfer connector while oxygen gas is transferred to the portable apparatus and to the patient from the primary reservoir container through the main-unit oxygen transfer connector.

DETAILED DESCRIPTION OF THE PREFERRED EMBODIMENTS

Figure 1:
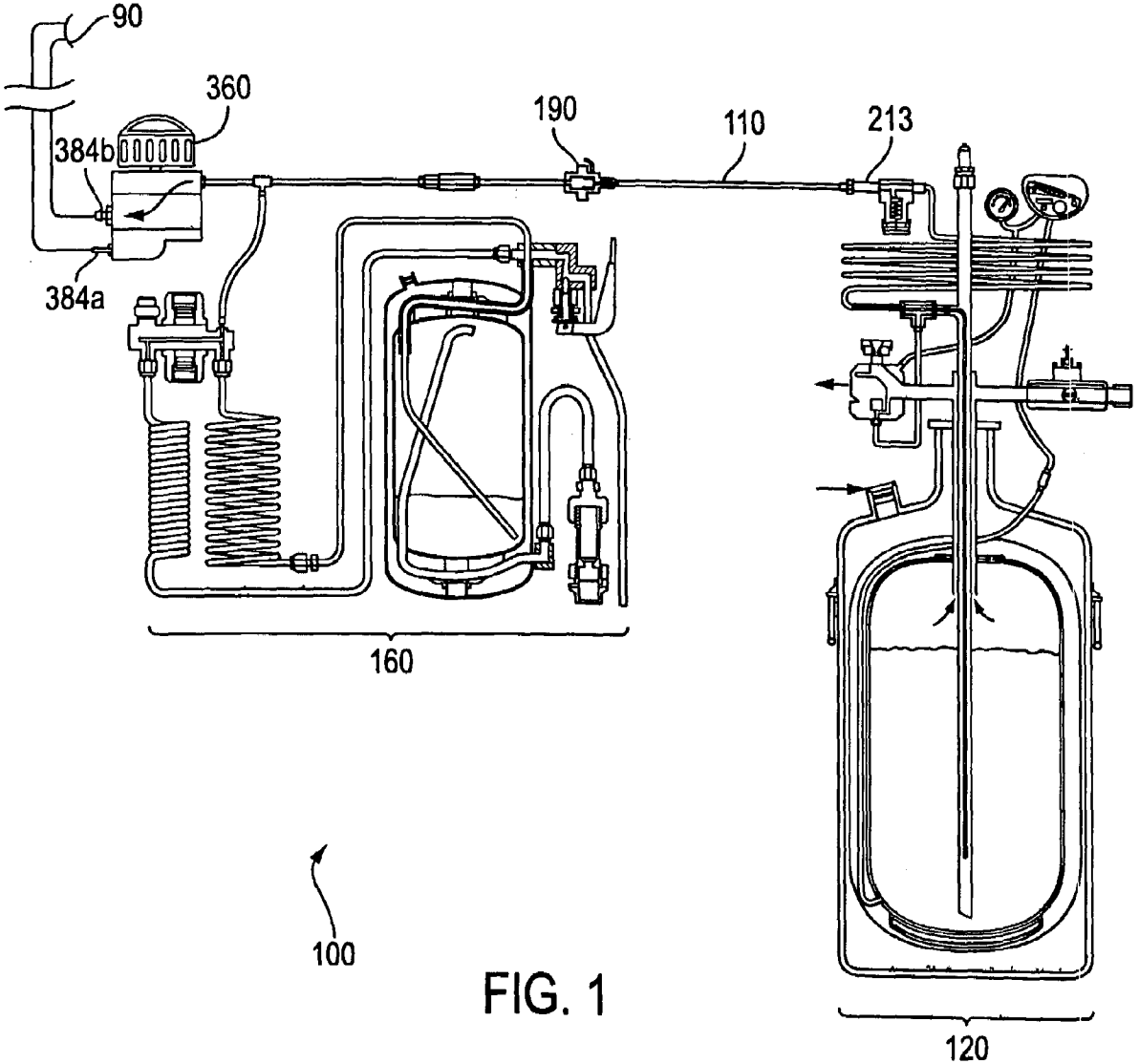
FIG. 1 schematically shows one embodiment of a high efficiency LOX system of the present invention, and illustrates how the primary reservoir and portable LOX storage/deliver apparatus may be interconnected.

FIG. 1 shows one embodiment of a high efficiency LOX system 100 of the present invention. The LOX system 100 includes a primary reservoir LOX storage/delivery apparatus (primary reservoir apparatus) 120 and a portable LOX storage/delivery apparatus (portable apparatus) 160. An umbilical conduit 110 may extend between an inter-unit oxygen gas transfer connector 190 of the portable apparatus 160 and a main-unit oxygen gas transfer connector 213 of the primary reservoir apparatus 120, and may be used to transfer gaseous oxygen therebetween. An oxygen delivery device 90, such as a mask or nasal tubes or cannulas may be attached to either apparatus in order to deliver gaseous oxygen to a patient. Alternatively, the inter-unit oxygen gas transfer connector 190 may be directly connected to the main-unit oxygen gas transfer connector 213.

Because LOX transforms from a liquid to a gas as heat is added, related art LOX systems have typically relied on venting of excess gaseous pressure to maintain acceptable internal pressure levels. The result is a higher cost for the health care provider. Pressure control of the portable apparatus 160 and the primary reservoir apparatus 120 is of great importance, as keeping pressures down yields a safe, light weight, economical system through the reduction or elimination of venting. The present invention achieves such economy by balancing use of the primary reservoir apparatus 120 and portable apparatus 160 so that internal pressures do not build up to a point where either apparatus must be excessively vented. The LOX system 100 therefore allows usage cycles that make possible efficient LOX use without excessive venting.

The primary reservoir apparatus 120 can be of any usable size for storage and delivery of LOX over a desired time period. Suitable units in accordance with the present invention can hold from 20–60 or more liters of LOX. In accordance with one embodiment, a primary reservoir container holding about 36 liters (about 85 pounds) of LOX is provided. In a second embodiment, a primary reservoir container holding about 43 liters (about 110 pounds) of LOX is provided.

The primary reservoir apparatus 120 includes the main LOX storage and container. The LOX may be transferred from the primary reservoir apparatus 120 to the portable apparatus 160 as needed to charge the portable apparatus 160 for mobile use.

The primary reservoir apparatus 120 is intended to hold a sufficiently large charge so that the primary reservoir apparatus 120 can recharge the portable apparatus 160 on a substantially daily basis for a substantially long period of time, e.g., up to about one month or more. This can reduce recharge costs by up to seventy-five percent or more over the related art.

The portable apparatus 160 preferably is about 3.5 pounds fully charged with LOX and about 2.5 pounds empty, is much smaller and lighter than the primary reservoir apparatus 120, and may provide gaseous oxygen to the patient while being carried by the patient.

In use, the primary reservoir apparatus 120 is charged with LOX. The patient may use gaseous oxygen from the primary reservoir apparatus 120 directly via the main-unit oxygen gas transfer connector 213, or may transfer LOX to the portable apparatus 160 wherein the patient may withdraw gaseous oxygen from the portable apparatus 160. The portable apparatus 160 allows the patient mobility outside the home, while the umbilical conduit 110, which may be up to 50–100 feet in length or longer, allows the patient to connect the portable apparatus to the main reservoir container to conserve LOX.

The inter-unit oxygen gas transfer connector 190 may be connected to the main-unit oxygen gas transfer connector 213 of the primary reservoir apparatus 120 to allow oxygen gas withdrawal alternatively from either the portable apparatus 160 or the primary reservoir apparatus 120, or simultaneously from both.

Figure 2:
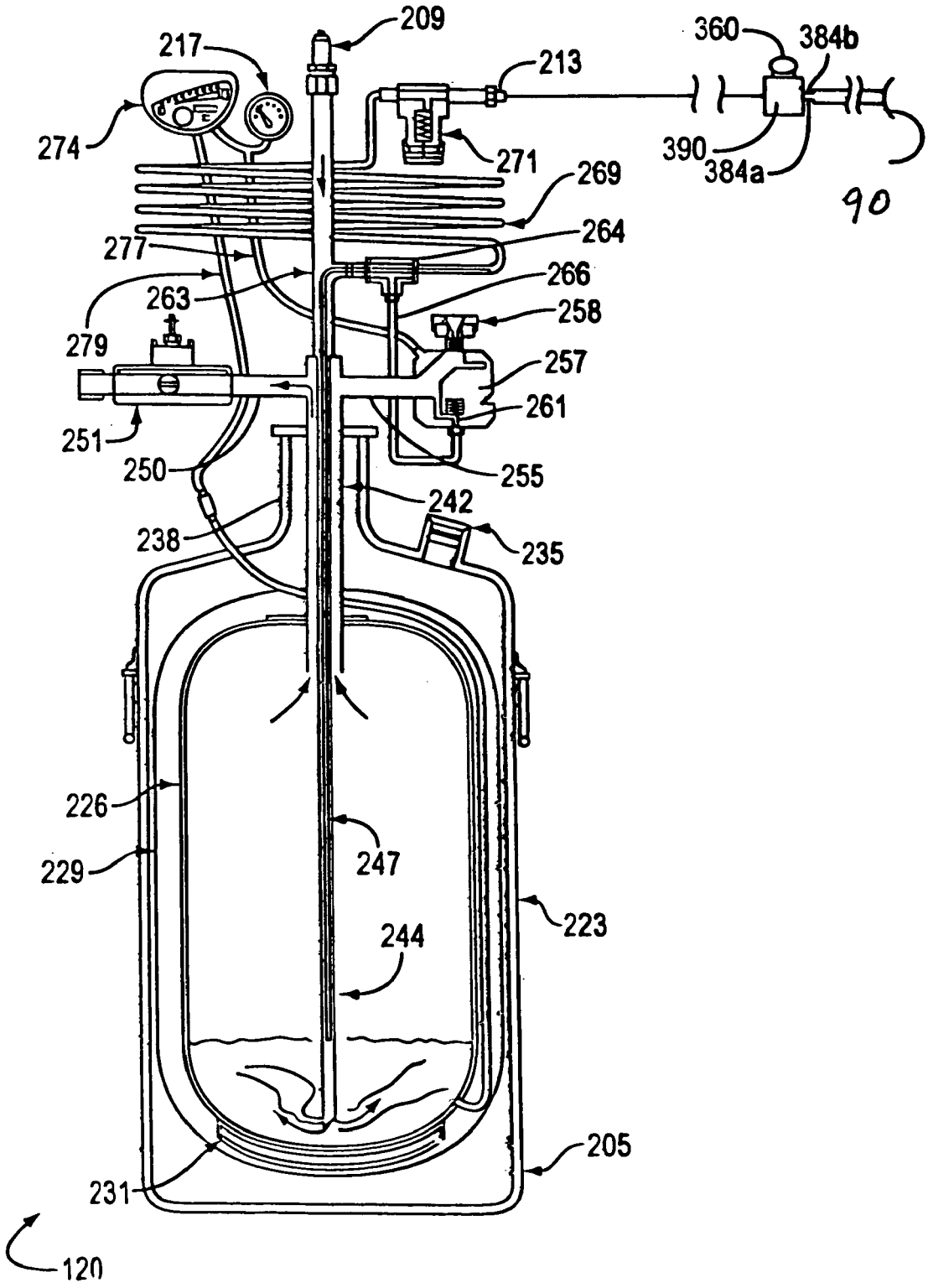
FIG. 2 schematically shows detail of one embodiment of the primary reservoir LOX storage/delivery apparatus.

FIG. 2 shows detail of one embodiment of the primary reservoir apparatus 120. The primary reservoir apparatus 120 includes a primary reservoir container assembly 205, a main LOX transfer connector 209, a main-unit oxygen gas transfer connector 213, and a main-unit primary relief valve 257. In the embodiment shown, a primary indicator device 274 also is included.

The primary reservoir container assembly 205 includes an outer container 223, an inner primary reservoir LOX container 226 spaced apart from the outer container 223, insulation 229 located between the outer container 223 and the inner container 226, a molecular sieve 231, and a vacuum plug 235. The space between the outer container 223 and the inner container 226 is preferably evacuated to at least a partial vacuum in order to minimize heat transfer to the LOX inside the inner container 226.

The primary reservoir LOX container assembly 205 also includes an outlet port 238, through which passes a neck conduit 242. The neck conduit 242 extends a short distance into the inner container 226, and is employed for gaseous oxygen withdrawal from the primary reservoir LOX container 226. Inside the neck conduit 242 is a fill conduit 244, preferably concentric with the neck conduit 242. The fill conduit 244 may be used to fill the primary reservoir LOX container 226 with LOX. Inside the fill conduit 244 is a liquid withdrawal conduit 247, preferably concentric with the fill conduit 244. The liquid withdrawal conduit 247 may be used to withdraw LOX from the primary reservoir LOX container 226.

Above the outlet port 238 of the primary reservoir LOX container 205 the neck conduit 242 splits into two independent conduits. A main-unit vent valve conduit 250 leads to a main-unit vent valve 251 which is openable for filling inner container 226 with LOX through the main LOX transfer connector 209. When filling inner container 226 with LOX, main unit vent valve 251 is opened until liquid exits valve 251, indicating that container 226 is filled with LOX.

Relief/economizer conduit 255 leads to a main-unit primary relief valve 257 and an economizer valve 261. The main-unit primary relief valve 257 is provided for relieving excess internal gas pressure from the primary reservoir LOX container 226 if the internal gas pressure exceeds a predetermined limit, e.g., 55 psi. Conduit 255 also leads to a main-unit secondary relief valve 258, which can be set at the same or a higher level (e.g., 10–20% higher) than the main-unit primary relief valve, and is a back-up thereto in case of failure thereof.

Conduit 255 further leads to an economizer valve 261, the purpose of which will be explained below.

Above the neck conduit 242 extends the fill conduit 244, which extends upward to the main-unit LOX transfer connector 209. Between the top of the neck conduit 242 and the main-unit LOX transfer connector 209 is a tee 263, where the liquid withdrawal conduit 247 exits the fill conduit 244. After exiting the fill conduit 244, the liquid withdrawal conduit 247 encounters a second tee 264 that joins the liquid withdrawal conduit 247 with an economizer conduit 266 in advance of a warming coil 269. The economizer conduit 266 connects the economizer valve 261 with warming coil 269. Gaseous oxygen passes through economizer valve 261 when the economizer valve is open. In order to conserve LOX, the economizer valve 261 can be set at any suitable level below the primary and secondary relief valve settings, so that gaseous oxygen will pass through the economizer valve 261 into the warming coil 269 before such gaseous oxygen is vented through the main-unit primary relief valve 257 or the main-unit secondary relief valve 258. One suitable setting for the economizer valve 261 is 22 psi. The liquid withdrawal conduit 247 supplies LOX to the warming coil 269, while the economizer conduit 266 supplies gaseous oxygen withdrawn by way of the relief/economizer conduit 255. In the warming coil 269 the withdrawn LOX and gaseous oxygen is warmed by exposure to room temperature, speeding the liquid-to-gas transformation. It should be noted that the inside diameter of the warming coil 269 may be greater than the inside diameter of the liquid withdrawal conduit 247, allowing the LOX to expand as it warms up and transforms from a liquid phase to a gaseous phase. However, the inside diameter of the liquid withdrawal conduit 247 preferably is sized so that when the economizer valve 261 is open, gas flow through line 266 is favored to warming coil 269 over liquid withdrawal through conduit 247. In the embodiment shown, the warming coil 269 is connected to a pressure regulator 271 which can maintain a desired operating pressure at a main-unit oxygen gas transfer connector 213.

In the embodiment shown, the primary reservoir LOX container 205 includes a primary indicator device 274 that indicates a LOX level in the primary reservoir LOX container 226. The primary indicator device 274 is connected to a bottom portion of the primary reservoir LOX container 226 via a high pressure sensing conduit 279. The primary indicator device 274 may be interconnected to a pressure gauge 217. The pressure gauge 217 gives a visual readout of an internal gas pressure for the primary reservoir LOX container 226, and may be, for example, a mechanical pressure gauge. The pressure gauge 217 is connected to conduit 255 via a low pressure sensing conduit 277.

In use, LOX may be added to or withdrawn from the primary reservoir LOX container 226 through the main-unit LOX transfer connector 209 and the fill conduit 244. The main-unit oxygen gas transfer connector 213 may be used to withdraw gaseous oxygen for use. The gaseous oxygen is provided to the main-unit oxygen gas transfer connector 213 from the economizer valve 261 and/or by conversion of LOX to gas through the liquid withdrawal conduit 247, both through the warming coil 269.

Figure 3:
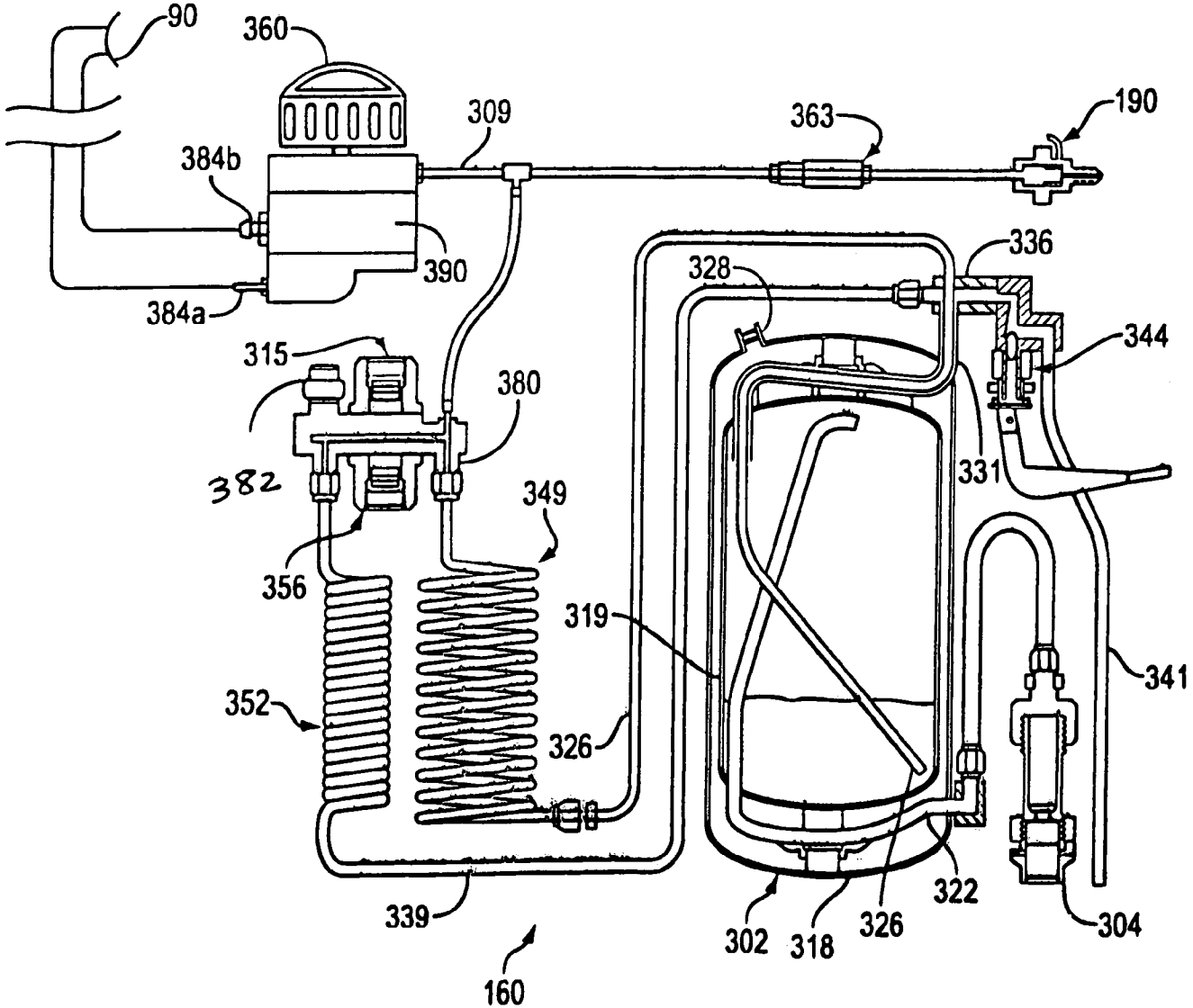
FIG. 3 schematically shows detail of one embodiment of the portable LOX storage/delivery apparatus.

FIG. 3 shows detail of one embodiment of the portable apparatus 160. The portable apparatus 160 includes a portable LOX container 302, a portable-unit LOX transfer connector 304, a portable-unit oxygen gas transfer connector 384, an inter-unit oxygen gas transfer connector 190, and a portable-unit primary relief valve 315.

The portable container assembly 302 includes an outer container 318, an inner portable LOX container 319 spaced apart from the outer container 318, a fill conduit 322, a liquid withdrawal conduit 326, a vacuum plug 328, and a multi-lumen annular conduit 331. The space between the outer container 318 and the inner container 319 is preferably evacuated to at least a partial vacuum in order to minimize heat transfer to the LOX inside the inner container 319.

LOX may be introduced into the portable LOX container 319 through the portable-unit LOX transfer connector 304 and the fill conduit 322. The portable-unit LOX transfer connector 304 may be connected to the main-unit LOX transfer connector 209 of the primary reservoir apparatus 120, whereby the portable apparatus 160 may be filled with LOX from the primary reservoir apparatus 120.

LOX may be withdrawn via the liquid withdrawal conduit 326, and gaseous oxygen may be withdrawn via the neck conduit 331.

A manifold 336 is connected to the neck conduit 331, and splits the neck conduit 331 into a gaseous oxygen withdrawal conduit 339 and a vent conduit 341. The vent conduit 341 may include a vent valve 344. The vent valve 344 may be opened during filling of the portable LOX container 302. When LOX emerges from the vent conduit 341, it is a visual indication that the portable LOX container 319 is full.

In the embodiment shown, the liquid withdrawal conduit 326 passes through the manifold 336 and is connected to a liquid withdrawal warming coil 349 in which the LOX can transform to the gaseous phase. The liquid withdrawal warming coil 349 warms the LOX by exposure to room temperature, speeding the liquid-to-gas transformation. It should be noted that the inside diameter of the liquid withdrawal warming coil 349 may be greater than the inside diameter of the liquid withdrawal conduit 326, allowing the LOX to expand as it warms up and transforms from a liquid phase to a gaseous phase.

The gaseous oxygen withdrawal conduit 339 connects with a gas withdrawal warming coil 352. The gas withdrawal warming coil 352 warms the gaseous oxygen before delivery to an oxygen user.

Connected to the gas withdrawal warming coil 352 is a portable-unit primary relief valve 315. The portable-unit primary relief valve 315 is capable of opening and relieving a gaseous oxygen pressure in the portable LOX container 319 if the internal gas pressure exceeds a predetermined level, e.g., 27 psi.

An economizer valve 356 connects the gas withdrawal warming coil 352 with conduit 380 containing gaseous oxygen from liquid withdrawal warming coil 349. The portable-unit economizer valve 356 can be set at any suitable level below the portable-unit primary relief valve 315, such as 22 psi, and allows gaseous oxygen from coil 352 to pass into line 380 when the pressure of the gaseous oxygen in the portable LOX container 319 exceeds the predetermined threshold level, e.g., 22 psi. In preferred embodiments, the inside diameter of the liquid withdrawal conduit 326 is sized so that when the portable-unit economizer valve 356 is open, gas flow through line 339 is favored over liquid flow through conduit 326. This permits gaseous oxygen from the gaseous headspace in portable container 319 to pass to the patient without the need to waste through the portable-unit primary relief valve 315. The portable-unit economizer valve 356 thus balances gaseous and liquid oxygen withdrawal from the portable LOX container 319, and outputs a resulting gaseous oxygen to a conduit 309. A portable-unit secondary relief valve 382 is provided as a back-up unit to the portable-unit primary relief valve 315, and can be set at the same or a higher level than the portable-unit primary relief valve, and is a back-up thereto in case of failure thereof.

Although the function of the economizer valves of the present invention has been described above with reference to preferred embodiments, other configurations, utilizing operating systems of any suitable pressure, will fall within the scope of the present invention. For example, with systems operating at 20 psig, an economizer valve may be set at any suitable setting such as between 19.5 psig and 22 psig. Alternatively, for systems having operating pressures at about 50 psig, economizer valves having settings, for example, between 48 psig and 55 psig can be utilized. Corresponding primary relief setting for a 20 psig system can, for example, be between 21 psig and 24 psig. Corresponding primary relief settings for a 50 psig system can, for example, be between about 50 psig and 58 psig. However, these configurations are merely exemplary, and other configurations can be utilized in accordance with the present invention.

The gaseous oxygen from the conduit 309 may be delivered to a demand flow control device 360, which also may receive gaseous oxygen from the primary reservoir apparatus 120 via the inter-unit oxygen gas transfer connector 190. A check valve 363 may be included between the conduit 309 and the inter-unit oxygen gas transfer connector 190 to prevent backflow of gaseous oxygen from the portable apparatus 160 to the primary reservoir apparatus 120.

The demand flow control device 360 is for adjustment of gas flow through a portable-unit oxygen gas transfer connector 384*a* to an oxygen delivery device 90 for delivery of gaseous oxygen to a patient.

Gaseous oxygen is provided to the patient through the portable-unit oxygen gas transfer connector 384*a*, either from the portable unit, or from the main reservoir unit through connector 190.

In preferred embodiments, the demand flow control device 360 can be connected to a gas conserving device 390. A known conserving device is disclosed in U.S. Pat. No. 5,360,000.

In the embodiment shown, a gas transfer connector system 384*a* and 384*b* is utilized, so that when the patient exhales, flow to the oxygen delivery device 90 is stopped, and gas accumulates in the conserving device 390. When the patient inhales, a puff (bolus) of oxygen gas is delivered to the patient from conserving device 390, thereby further preventing waste of gaseous oxygen, followed by an even flow of gaseous oxygen, which then is stopped again when the patient exhales.

Use of a conserving device 390 with the portable apparatus of the present invention connected to the primary reservoir apparatus 120 through connector 190 results in tremendous savings and LOX conservation.

A method of utilizing the high-efficiency LOX storage/delivery system 100 of the present invention is disclosed. The method uses an umbilical conduit 110 to economize oxygen use by a patient and balance use of the primary reservoir apparatus 120 and portable apparatus 160 so that excess oxygen venting is avoided.

The main-unit oxygen gas transfer connector 213 is connected to the inter-unit oxygen gas transfer connector 190, e.g., by umbilical conduit 110. The connection allows gaseous oxygen to flow from the primary reservoir apparatus 120 to the portable apparatus 160. The gaseous oxygen from either the primary reservoir LOX storage delivery apparatus 120 or the portable apparatus 160 may be provided to the patient, depending on which has the higher gas pressure.

The umbilical conduit 110 may be a flexible conduit (such as a hose, for example) to give the portable apparatus 160 mobility while yet being connected to the primary reservoir apparatus 120. In this hookup, the oxygen deliver device 90 is connected to the demand flow control device 360 in order to provide gaseous oxygen to the patient.

The method may utilize a filling/using cycle of the portable apparatus 160. The method of filling/using of the present invention avoids or reduces unnecessary venting of either the portable apparatus 160 or the primary reservoir apparatus 120.

Gaseous oxygen is withdrawn from the primary reservoir 120 for a withdrawal time period, which preferably is at least 5 hours per day, more preferably about 10 hours per day or more. The withdrawal of gaseous oxygen from the primary reservoir apparatus 120 may be through oxygen delivery device 90 either connected directly to connector 213, or connected to connector 384 of the portable apparatus with connector 190 of the portable apparatus connected to the main reservoir apparatus. This gaseous withdrawal time period hook-up to the primary reservoir apparatus 120 permits withdrawal of gaseous oxygen from the primary reservoir LOX container without internal pressure in the primary reservoir LOX container reaching excess levels requiring venting. This conserving measure, in conjunction with economizer valve 261 (and economizer valve 356 if the portable unit is hooked-up), enables oxygen withdrawal without wasteful venting.

After the above-discussed withdrawal time period, the portable apparatus 160 may be filled with LOX from the primary reservoir apparatus 120 and disconnected, for example, if the patient wishes to go outside the home.

In preferred embodiments, the portable LOX container holds about 1 pound of LOX, which, when utilized with the portable LOX/delivery apparatus of the present invention, can last approximately 10 hours at a typical patient use/withdrawal rate of about 2 liters per minute.

During withdrawal of gaseous oxygen from the primary reservoir LOX apparatus, oxygen gas pressure in the primary reservoir LOX apparatus is reduced to a level at which the economizer valve is set (e.g., 22 psi) such that after the portable container is filled with LOX and disconnected from the primary reservoir LOX apparatus, pressure may increase within the primary reservoir container for a gas pressurizing period within a range of 5–15 hours per day, e.g., about 10 hours per day, to a pressure of, for example, about 50 psi without LOX or oxygen gas being withdrawn from the primary reservoir container and without oxygen gas being vented from the primary reservoir container during the gas pressurizing period.

When the patient returns home prior to complete withdrawal of oxygen gas from the portable LOX container, the inter-unit oxygen gas transfer connector of the portable LOX container is connected to the main-unit oxygen transfer connector of the primary reservoir LOX container, and oxygen gas may be withdrawn from the portable LOX container or the primary reservoir LOX container while oxygen gas may be transferred to the portable LOX apparatus from the primary reservoir LOX container through the main-unit oxygen transfer connector, depending on the pressure differential between the containers.

In accordance with one embodiment, during the withdrawal period, the inter-unit oxygen gas transfer connector of the portable LOX container is connected to the main-unit oxygen transfer connector of the primary reservoir LOX container, and oxygen gas is transferred from the portable container to the oxygen gas delivery device alternately or concurrently with oxygen gas being transferred to the oxygen gas delivery device through the portable LOX apparatus from the primary reservoir LOX container, thereby lowering gas pressure in the primary reservoir LOX container.

The present invention can provide significant savings as compared to related art systems. For example, at a patient use rate of 2 liters per minute, related art systems utilize about 10 pounds LOX per day. The present invention can provide the same 2 liters per minute utilizing about 2 pounds LOX per day, a savings of up to about 8 pounds LOX per day.

While the invention has been described in detail above, and shown in the drawings, the invention is not intended to be limited to the specific embodiments as described and shown.

What is claimed is:

1. A portable, high-efficiency liquid oxygen (LOX) storage/delivery apparatus, comprising:

a portable LOX container;

a portable-unit LOX transfer connector connected to said portable container and capable of receiving and transferring LOX to said portable container;

an economizer valve for minimizing venting by balancing gaseous oxygen withdrawn from said portable LOX container via a gas withdrawal conduit and liquid oxygen withdrawal from said portable LOX container via a liquid withdrawal conduit, wherein an inner diameter of said liquid withdrawal conduit is sized so that when said economizer valve is open, gaseous flow from the head-space of said portable LOX container is preferred over flow through said liquid withdrawal conduit; and a portable-unit oxygen gas transfer connector for transferring oxygen gas to an oxygen gas delivery device for delivery.

2. The apparatus of claim 1, wherein said economizer valve opens to allow oxygen gas from a gaseous head-space in said portable LOX container to pass through when the pressure of said oxygen gas in said portable LOX container exceeds a predetermined threshold level and otherwise is closed and allows oxygen gas from evaporated LOX to pass through.

3. The apparatus of claim 2, wherein said economizer valve further comprises a relief valve.

4. The apparatus of claim 1, further comprising at least one of a liquid withdrawal warming coil and a gaseous withdrawal warming coil.

5. The apparatus of claim 4, wherein an inner diameter of said liquid withdrawal warming coil is greater than the inner diameter of said liquid withdrawal conduit.

6. The apparatus of claim 1, further comprising a vent valve.

7. The apparatus of claim 6, wherein said vent valve may be open during filling of said portable LOX container.

8. The apparatus of claim 1, further comprising a demand flow control device for adjustment of gas flow through said portable-unit oxygen gas transfer connector.

9. The apparatus of claim 1, further comprising an inter-unit oxygen gas transfer connector.

10. The apparatus of claim 9, further comprising a check valve to prevent backflow of gaseous oxygen through said inter-unit oxygen gas transfer connector.

11. The apparatus of claim 1, wherein said apparatus weighs 3 to 5 pounds when said portable LOX container is fully charged with LOX.

12. The apparatus of claim 1, wherein said apparatus can deliver a gas withdrawal rate of about 2 liters per minute with a LOX use rate up to about 1/12 pounds per hour.

13. The apparatus of claim 1, wherein said portable LOX container is configured to hold about one pound of LOX when fully charged with LOX.

14. The apparatus of claim 1, wherein said LOX storage/delivery apparatus can last approximately 10 hours at a typical patient use rate of about 2 liters per minute.

15. A portable, high-efficiency liquid oxygen (LOX) storage/delivery apparatus, comprising:

a portable LOX container;

a portable-unit LOX transfer connector connected to said portable container and capable of receiving and transferring LOX to said portable container;

an economizer valve for minimizing venting by balancing gaseous and liquid oxygen withdrawal from said portable LOX container, said economizer valve opening to allow oxygen gas from a gaseous head-space in said portable LOX container to pass through when the pressure of said oxygen gas in said portable LOX container exceeds a predetermined threshold level and otherwise is closed and allows oxygen gas from evaporated LOX to pass through;

a liquid withdrawal conduit and a gaseous withdrawal conduit in communication with the interior of said LOX container, said liquid withdrawal conduit having an inner diameter sized so that when said economizer valve is open, gaseous flow from said head-space of said portable LOX container is preferred over flow through said liquid withdrawal conduit;

a conserving device; and a portable-unit oxygen gas transfer connector for transferring oxygen gas to an oxygen gas delivery device for delivery.

16. A portable, high-efficiency liquid oxygen (LOX) storage/delivery apparatus, comprising:

a portable LOX container;

a portable-unit LOX transfer connector connected to said portable container and capable of receiving and transferring LOX to said portable container;

a liquid withdrawal conduit and a gaseous withdrawal conduit in communication with the interior of said LOX container;

an economizer valve for minimizing venting by controlling the flow of gas from said gaseous withdrawal conduit through said valve relative to the flow of gas from said liquid withdrawal conduit through said valve, said gas from said liquid withdrawal conduit comprising evaporated liquid from said liquid withdrawal conduit;

wherein said liquid withdrawal conduit has an inner diameter sized so that when said economizer valve is open, gaseous flow from said gaseous withdrawal conduit takes precedence over gaseous flow from said liquid withdrawal conduit;

a conserving device; and a portable-unit oxygen gas transfer connector for transferring oxygen gas to an oxygen gas delivery device for delivery.

17. A portable, high-efficiency liquid oxygen (LOX) storage/delivery apparatus, comprising:

a portable LOX container;

a portable-unit LOX transfer connector connected to said portable container and capable of receiving and transferring LOX to said portable container;

an economizer valve for minimizing venting by balancing gaseous oxygen withdrawn from said portable LOX container via a gas withdrawal conduit and liquid oxygen withdrawal from said portable LOX container via a liquid withdrawal conduit, wherein a portion of the liquid withdrawal conduit is located within a portion of the gas withdrawal conduit; and a portable-unit oxygen gas transfer connector for transferring oxygen gas to an oxygen gas delivery device for delivery.

18. A portable, high-efficiency liquid oxygen (LOX) storage/delivery apparatus, comprising:

a portable LOX container;

a portable-unit LOX transfer connector connected to said portable container and capable of receiving and transferring LOX to said portable container;

an economizer valve for minimizing venting by balancing gaseous oxygen withdrawn from said portable LOX container via a gas withdrawal conduit and liquid oxygen withdrawal from said portable LOX container via a liquid withdrawal conduit, wherein a portion of the liquid withdrawal conduit is concentric with a portion of the gas withdrawal conduit; and a portable-unit oxygen gas transfer connector for transferring oxygen gas to an oxygen gas delivery device for delivery.

19. A portable, high-efficiency liquid oxygen (LOX) storage/delivery apparatus, comprising:

a portable LOX container;

a portable-unit LOX transfer connector connected to said portable container and capable of receiving and transferring LOX to said portable container;

an economizer valve for minimizing venting by balancing gaseous oxygen withdrawn from said portable LOX container via a gas withdrawal conduit and liquid oxygen withdrawal from said portable LOX container via a liquid withdrawal conduit, wherein the liquid withdrawal conduit and the gas withdrawal conduit open into the interior of the portable LOX container at locations substantially diagonal from each other relative to the interior of the portable LOX container; and a portable-unit oxygen gas transfer connector for transferring oxygen gas to an oxygen gas delivery device for delivery.

* * * * *